United States Patent [19]

Lonati

[11] 4,291,554

[45] Sep. 29, 1981

[54] DEVICE FOR CHANGING THE NUMBER OF THE NEEDLES AT WORK IN A CIRCULAR KNITTING MACHINE FOR STOCKINGS AND LIKE ARTICLES

[75] Inventor: Francesco Lonati, Brescia, Italy

[73] Assignee: Lonati S.p.A., Brescia, Italy

[21] Appl. No.: 24,291

[22] Filed: Mar. 27, 1979

[30] Foreign Application Priority Data

Apr. 3, 1978 [IT] Italy ..... 21923 A/78

[51] Int. Cl.[3] ..... D04B 9/20

[52] U.S. Cl. ..... 66/53

[58] Field of Search ..... 66/47, 48, 51, 52, 53, 66/73

[56] References Cited

U.S. PATENT DOCUMENTS

| | | | |
|---|---|---|---|
| 519,170 | 5/1894 | Branson | 66/53 |
| 608,040 | 7/1898 | Groupe | 66/53 |
| 629,503 | 7/1899 | Hemphill | 66/47 |

FOREIGN PATENT DOCUMENTS

| | | | |
|---|---|---|---|
| 2625963 | 12/1976 | Fed. Rep. of Germany | 66/51 |
| 1050677 | 12/1966 | United Kingdom | 66/47 |
| 1053128 | 12/1966 | United Kingdom | 66/48 |

*Primary Examiner*—Wm. Carter Reynolds

*Attorney, Agent, or Firm*—Guido Modiano; Albert Josif

[57] ABSTRACT

The device for changing the number of the needles knitting in a circular knitting machine for stockings and like articles, comprises a single picker configurated for operation in either directions of reciprocation of the needle cylinder or cylinders and arranged at that area where a conventional needle lowering picker is arranged. The single picker is rotatable through 180° substantially about the longitudinal axis thereof for assuming respectively a position in which it operates as a needle raising picker and a position in which it operates as a needle lowering picker.

3 Claims, 5 Drawing Figures

DEVICE FOR CHANGING THE NUMBER OF THE NEEDLES AT WORK IN A CIRCULAR KNITTING MACHINE FOR STOCKINGS AND LIKE ARTICLES

BACKGROUND OF THE INVENTION

This invention relates to a device for changing the number of the needles at work in a circular knitting machine for stockings and like articles.

Such changing is known to become necessary as the knitting of the heel portion of a stocking article begins, when the number of the needles at work must be first decreased and then increased gradually again to form the heel pouch. The change is effected by means of the so-called needle raising and lowering pickers, which during the reciprocating movement of the needle cylinder(s) are active to respectively exclude from knitting one or more needles, by moving them to a raised track whereat they are not knitting, and return them back to the knitting track. There are commonly provided two needle raising pickers, which are respectively located on either sides of a yarn or thread feed, being each adapted for operating in one direction of reciprocation of the needle cylinder(s), and one needle lowering picker, which is configurated to operate in both directions of reciprocation. The pickers act directly on the needles in the single cylinder machines, and on the sliders in the double cylinder machines.

The problems connected with these pickers have several aspects. In particular, it should be considered that at each stroke of the reciprocating motion of the needle cylinder the last needle which has picked up the yarn during the knitting of the first half of the heel pouch must then be excluded by the picker at the start of the following stroke. This fact implies that said last needle will no more be knitting at the successive stroke, while the feed yarn previously caught by said last needle winds itself around the stem of the needle as this is raised to be excluded. It follows that the yarn is stretched, the particular rippled configuration of the needle contributing to said stretching, which can easily result in the breaking of the yarn, and attendant discarding of the knitted product. That phenomenon is specially frequent when a comparatively weak yarn is used, or when a rather tight loop is being knitted.

Another problem, which however, contrary to the former, only affects those double cylinder machines which are equipped with false sinkers associated with the sinkers, originates from the fact that the raising of the sliders to exclude the respective needles may be obstructed by the protruding false sinkers as the latter, for a reason whatever such as because worn out or damaged, fail to slide in their seats properly and have difficulty to re-enter. In this case, the sliders, which are provided at the top with a tab, collide therewith, in their upward movement as produced by the picker, against the respective false sinkers, thereby they cannot reach the correct height. Thus, the cylinder rotation brings the sliders to strike the stationary cams with their butts, thereby the butts break and the machine must be stopped to replace the damaged sliders, with obvious considerable losses in the production output.

SUMMARY OF THE INVENTION

This invention sets out to solve the problems mentioned by providing a device of the type generally described hereinabove, which in addition to avoiding the cited drawbacks of conventional devices has a simpler construction.

A further object of the invention is to provide such a device which permits a machine incorporating it to operate without trouble at higher than usual speeds.

These objects are achieved by a device for changing the number of the needles at work in a circular knitting machine for stockings and like articles, according to this invention, wherein the change is effected by means of needle raising pickers, respectively needle lowering pickers, the device being characterized in that it comprises a single needle raising picker configurated for operation in either directions of reciprocation of the needle cylinder(s), and arranged at that area where the needle lowering picker is arranged conventionally.

In a machine incorporating the instant device, the advantage is secured that the last needle which has picked up the yarn at each reciprocation stroke during the knitting of the first half of the heel pouch is no longer excluded at the following stroke before moving past the yarn feed, but is instead excluded after moving past the feed and picking up the yarn and forming a stitch. Thus, there exists no yarn wound and/or stretched on the needle, but just an ordinary knitwork loop, which being connected to the other loops and elastically deformable, allows the needle to slide and be excluded without any danger of breaking the yarn. To this advantage of a textile character, the structural advantage should be added which results from the elimination of both needle raising pickers arranged at the sides of the yarn feed, and their replacement with a single picker which is operative in either reciprocating directions and located in an almost free area of the machine. Also eliminated is the problem of the sliders striking the false sinkers because of the fact that the sliders are raised at an area where the false sinkers are retracted.

According to another aspect, the invention provides a further simplification of the device by having said single picker rotatable through an angle of 180° substantially about its own longitudinal axis, between a position whereat it operates as a needle raising picker and a position whereat it operates as a needle lowering picker.

A device so conceived affords the added advantage of reducing the number of the traditional three pickers in a circular hose knitting machine to a single picker, whether the machine is a single or double cylinder one. This device, moreover, is suitable for use in higher speed machines than the conventional machines, because it can act on needles or sliders at an area where no cams are provided, which cams, owing to a powerful impact against the needles or sliders, may dislodge the latter from their track, with attendant breaking of the butts. Advantageously, such a dual function picker can be prearranged in its reversed position already upon completion of the heel of a stocking article, ready for starting to knit the heel of the next stocking article, thus eliminating dead time. Owing to the 180° rotational movement being effected in a very short time, transition from one position to the other after one half of the heel has been completed involves in practice no operational dead time.

BRIEF DESCRIPTION OF THE DRAWINGS

Further characteristics and advantages of the invention will become more apparent from the following detailed description of a preferred embodiment thereof, given herein by way of example only and illustrated in the accompanying drawings, where.

DESCRIPTION OF A PREFERRED EMBODIMENT

Figure 1:
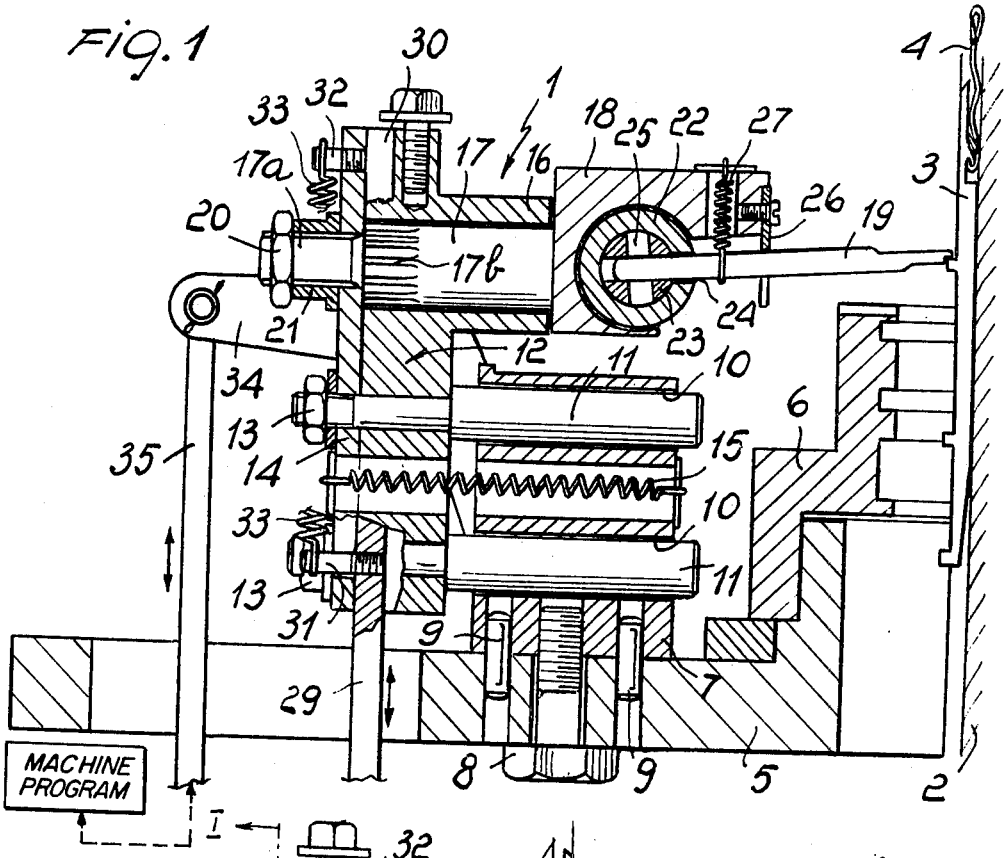
FIG. 1 is a vertical cross-sectional view of a device according to this invention, taken along the line I—I of FIG. 2, the device being represented as applied, for example, to a double cylinder circular knitting machine.

With reference to the drawing figures, there is indicated at 1 a device according to this invention as applied to a circular stockings (socks) knitting machine, whereof the lower cylinder 2 is schematically shown in which sliders 3 and needles 4 are mounted for a sliding movement, in a manner known per se. The reference numeral 5 denotes a stationary portion of the machine, which carries the device itself and cam supporting rings 6.

The device 1 comprises a base 7 which is attached to the portion 5 by means of a screw 8 and registering pins 9 at the area traditionally occupied by the needle lowering picker. The base 7 has two parallel passages 10 which extend, with the device 1 mounted on the machine, radially to the cylinder 2 and accommodate slidably a respective trunnion 11 each. At the end of the trunnions 11 remote from the cylinder 2, a supporting or holding body 12 is attached, e.g. by means of nuts 13 threaded on the threaded ends of the trunnions 11 to clamp the supporting body 12 between a plate 14 and an abutment surface on the trunnions themselves. Between the base 7 and supporting body 12, there stretches a spring 15 adapted for pulling the supporting body 12 towards the cylinder 2, to an operative position as will be explained hereinafter.

Above the base 7, the supporting body 12 has a hollow cylindrical lug 16, arranged parallel to the trunnions 11 and accommodating rotatably a shaft 17, which shaft has at its end next to the cylinder 2 a block 18 carrying a picker 19, and at the opposite end, a threaded lug 17*a*. A nut 20 is threaded onto the latter and acts on a bushing 21 in abutment relationship with the plate 14 for the purpose of retaining said shaft, in cooperation with the block 18, at a fixed axial location with respect to the supporting body 12.

The picker 19, the working end whereof is shaped similarly to that of a conventional needle lowering picker, i.e. has a substantially "T"-type of cross-section, is supported in the block 18 such as to be pivotable about two axes perpendicular to each other, a substantially vertical one and a substantially horizontal one, both intersecting the longitudinal axis of the shaft 17. More specifically, the picker 19 is carried by a pair of coaxial cylinders 22,23, mounted inside each other, the common axis whereof is orthogonal to the longitudinal axis of the picker 19 and defines said horizontal pivot axis of the picker. The hollow outer cylinder 22 is rotatably housed in the block 18 and provided with a horizontally elongated peripheral rectilinear opening or slot 24 for the passage and horizontal movement of the picker 19 therethrough. The inner cylinder 23 is instead formed with a diametrical seat, extending perpendicularly to the common axis of the cylinders 22 and 23 as well as to the axis of the picker 19, for accommodating a pivot pin 25 which penetrates the picker 19 at one end thereof and defines the substantially vertical pivot axis of the picker. Thus, the free end of the picker 19 is enabled to move in vertical and horizontal directions, like the traditional pickers, but the picker 19 can also turn together with the block 18 about the axis of the shaft 17, i.e. it can also rotate substantially about its own longitudinal axis which is only slightly away from the axis of the shaft 17. The height of the axis of the shaft 17 (and accordingly, of the support center of the picker 19) over the needle cylinder 2 is such that a horizontal plane passing through said axis is located at an intermediate height with respect to the height of the working end of a conventional needle lowering picker and a conventional needle raising picker, i.e. to the height of the paths followed respectively by the butts of the sliders or needles at work and of those held inoperative.

To the end of the block 18 next to the cylinder 2, a guide plate 26 for the picker 19 is attached which is traditionally shaped with a "V" notch, the picker being held against the edge of said notch by a spring 27.

For the rotation of the picker 19 about the axis of the shaft 17, a peripheral toothed region 17*b* is provided on the shaft itself, with which a straight toothed region 28 meshes which is provided on a drive rod 29 axially slidable in a groove 30 of the supporting body 12. A return or biasing spring 33 is stretched between a pin 31 rigid with the rod 29 and a pin 32 rigid with the plate 14, and accordingly with the supporting body 12. To the end of the rod 29 that protrudes from the supporting body 12, there is connected a tie member, not shown, which is controlled by the machine main drum through conventional means to displace the rod 29 axially. This displacement brings about, as it will be appreciated, a rotational movement of the shaft 17 and picker 19 which is limited, e.g. by means of stops not shown, such as to result in an exact 180° rotational movement.

Figure 2:
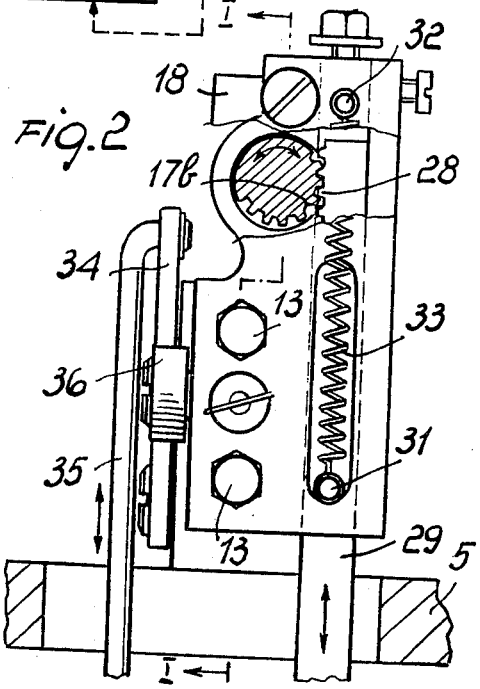
FIG. 2 is a partly sectional representation of the device of FIG. 1, as viewed from outside the lower needle cylinder.
Figure 4:
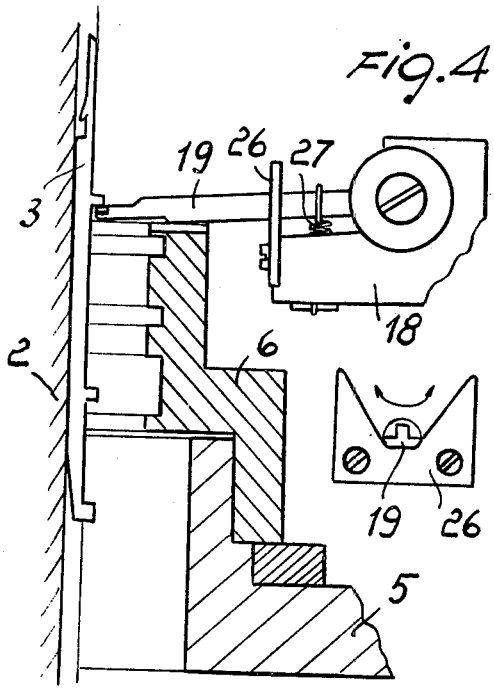
FIG. 4 is a partial view similar to FIG. 3, but with the picker in a position effective to control the needles to be raised.
Figure 5:
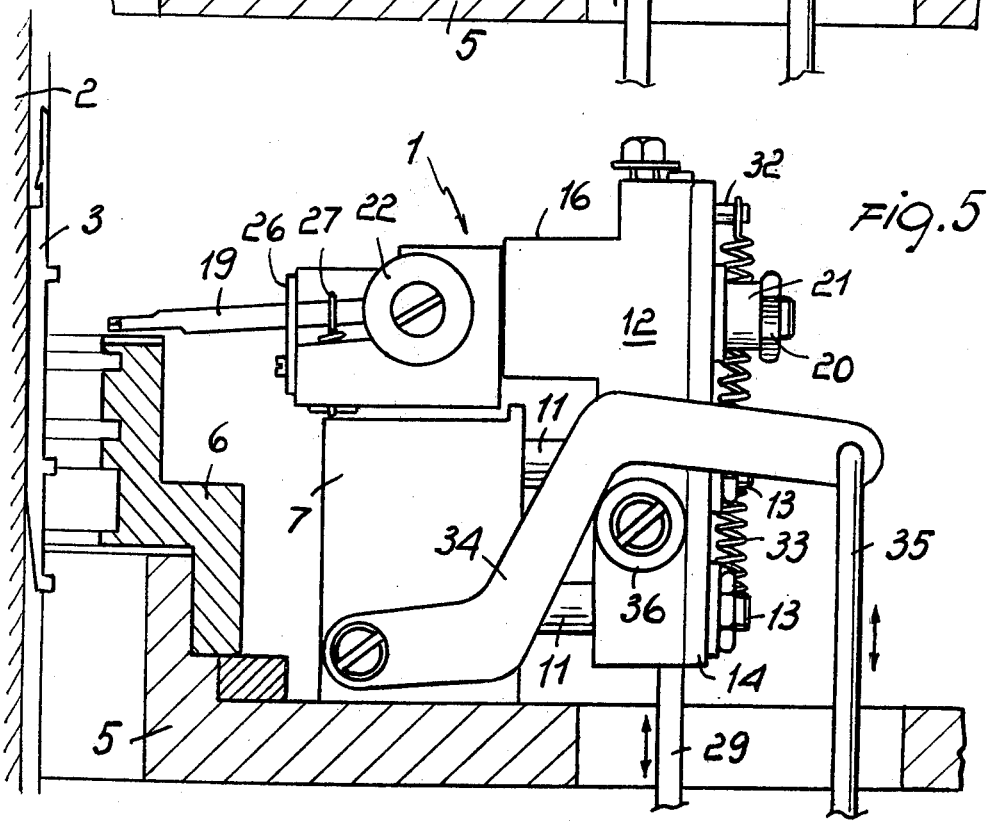
FIG. 5 is a view similar to FIG. 3, but with the device and picker shown in a rest or inoperative position.

Furthermore, the device 1 may be shifted radially with respect to the cylinder 2, from the operative position shown in FIGS. 1,2 and 4 wherein the picker 19 is allowed to act on the sliders 3, to a rest or inoperative position shown in FIG. 5, wherein the picker is moved away from the cylinder 2 and cannot be active on the sliders 3. To carry out this displacement movement, as guided by the axial sliding of the trunnions 11 in the passages 10 of the base 7, there is provided a substantially S-like lever 34, which is journalled with one end to the base 7 along a horizontal axis perpendicular to the direction of movement and is pivotally connected with the other end to a tie control member or link 35 actuated by the machine program. The middle portion of the lever 34, which is inclined over the horizontal, engages the peripheral surface of a roller 36 rotatably carried by the supporting body 12. It will be appreciated, by comparing FIGS. 3 and 5 together, that a movement of the link 35, as controlled for example by the machine main drum in a known manner, determines a radial movement of the device 1 by virtue of the lower inclined edge corner of the middle portion of the lever 34 cooperating with the roller 36, the movement occurring against the action of the spring 15 when the link 35 is pulled, and under the action of the spring 15 when the link 35 is released.

The device described in the foregoing operates as follows.

Figure 3:
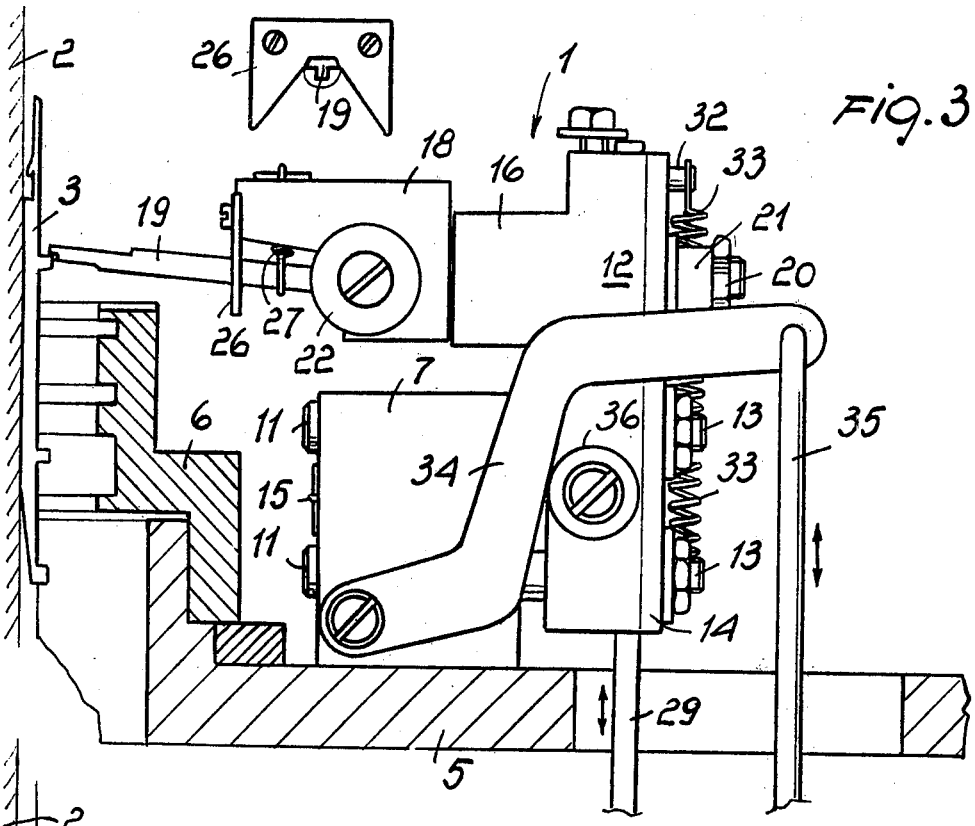
FIG. 3 is a view of the device of FIG. 1 from the opposite side to FIG. 1, with the picker being shown in a position effective to control the needles to be lowered.

The picker 19, arranged at the position traditionally occupied by the needle lowering picker, operates as a needle lowering picker when the block 18 is so oriented that the "V" notch in the guide plate 26 faces downwards (FIG. 3). In this case, the picker 19 moves like a conventional needle lowering picker, i.e. in a tangential direction to the cylinder under the thrust exerted by the sliders (or by the needles), and vertically downwards under the action of the edge of the "V" notch in the guide plate 26.

By a 180° rotation of the picker 19 about the axis of the shaft 17, as produced by the rod 29, the picker is automatically converted into a needle raising picker (FIG. 4). In fact, along with the picker 19, the block 18 and guide plate 26 also turn, thereby the picker is precisely in the same condition, considering the position of the shaft 17 as explained above, as a conventional needle raising picker, with the difference that the instant picker 19 is configurated to operate in either directions of reciprocation of the cylinder, and is moreover located in the area traditionally occupied by the needle lowering picker. The movement of the picker 19 under the action of the sliders (or of the needles) becomes, therefore, the horizontal and vertically upward movement which typifies a conventional needle raising picker.

Upon completion of the knitting at the heel of a stocking article, the picker 19, which occupies the position shown in FIG. 3, is shifted along with the entire device 1, under control by the link 35 and lever 34, out of the path of the sliders 3 (or of the needles), to the rest position shown in FIG. 5. Advantageously, in this position, the picker 19 can be prearranged already in the condition required for the needle raising picker operation mode at the beginning of the heel portion of the next stocking article, as shown again in FIG. 5.

It will be appreciated that a machine incorporating the above described device is not only free of the yarn breaking problems mentioned in the preamble, since the picker is located away from the knitting cams and acts on those needles which have already formed a knitwork loop, but also has a much simpler structure than conventional machines, it being equipped with a single picker instead of three, said single picker being quickly switched from the needle raising mode of operation to the needle lowering one, and vice versa.

It would be also possible to provide two discrete pickers at the area of operation of the traditional needle lowering picker, one picker being a needle lowering picker and the other a needle raising picker. Even in this case, however, the advantage would be secured of acting on needles which have already formed a knitwork loop (thus eliminating the danger of breaking the yarn), as well as a constructional advantage resulting from the reduction in the total number of pickers and from their being arranged at an area which is relatively free from accessory components for the machine operation. However, the provision of two adjacent pickers might require a slight increase of the needle cylinder stroke during the reciprocating movement thereof to allow for the lowering and raising of the needles which must be respectively brought to work and to rest. It will be obvious that the picker supporting system would not require in such a case the 180° pivoting feature.

The invention just described is susceptible to many modifications and variations thereof which all fall within the scope of the appended claims. Thus, for example, the drive means for the rotational movement of the picker 19 could differ from the ones described, as different could be the means for the radial displacement of the device 1. The system for supporting the picker 19 in the block 18 could be of conventional design. The picker 19 could also be coaxial with the shaft 17 in the rest position and/or the supporting body 12 could be displaceable vertically to bring the working end of the picker each time to the correct height for acting on the butts of the sliders or of the needles.

It will be appreciated that the invention applies equally well to single cylinder and double cylinder hose knitting machines.

I claim:

1. A device for changing the number of needles at work in a circular knitting machine of the type having at least one needle cylinder and means for reciprocating said at least one needle cylinder, the device comprising a picker for needle raising and lowering during reciprocation of said at least one needle cylinder, a supporting body for said picker, a shaft having a longitudinal axis extending substantially radially with respect to said at least one needle cylinder and rotatably housed in said supporting body about said longitudinal axis, a block secured to one end of said shaft, a pair of coaxial cylinders rotatably housed within said block, said cylinders including an inner cylinder and a hollow outer cylinder and having a common axis perpendicular to an intersecting said longitudinal axis of said shaft, said outer hollow cylinder having an elongate peripheral rectilinear opening for passage and movement of said picker, and said inner cylinder defining a diametrical seat having an axis perpendicular to said common axis of said inner and outer cylinder and to said picker and intersecting said longitudinal axis of said shaft and said common axis of said inner and outer cylinder, a pivot pin in said diametrical seat penetrating one end of said picker, and means for rotating said shaft about said longitudinal axis through substantially 180° to cause said picker to assume respectively a position for operating as a needle raising picker and a position for operating as a needle lowering picker.

2. A device as claimed in claim 1, further comprising a base attached to a machine stationary portion, passages in said base extending substantially radially with respect to said at least one needle cylinder, trunnions attached to said supporting body and axially slidable in said passages, and means for displacing said supporting body with respect to said base in the direction of said trunnions between an operative position of said picker and an inoperative position thereof.

3. A device as claimed in claim 2, wherein said means for displacing said supporting body with respect to said base comprise a substantially S-like lever having one end journalled to said base about a horizontal axis perpendicular to said trunnions and another end pivotally connected to a control link actuated by a machine program, said lever having a middle portion inclined with respect to a horizontal plane and cooperating with a peripheral surface of a roller rotatably carried by said supporting body.

* * * * *